US009121116B2

(12) United States Patent
Champion et al.

(10) Patent No.: US 9,121,116 B2
(45) Date of Patent: Sep. 1, 2015

(54) SHED FORMING DEVICE AND WEAVING MACHINE EQUIPPED WITH SUCH A DEVICE

(71) Applicant: STAUBLI FAVERGES, Faverges (FR)

(72) Inventors: Clement Champion, Cran Gevrier (FR); Denis Voincon, Annecy (FR); Sebastien Communal, Duingt (FR)

(73) Assignee: STAUBLI FAVERGES, Faverges (FR)

( * ) Notice: Subject to any disclaimer, the term of this patent is extended or adjusted under 35 U.S.C. 154(b) by 36 days.

(21) Appl. No.: 13/898,675

(22) Filed: May 21, 2013

(65) Prior Publication Data

US 2013/0312867 A1 Nov. 28, 2013

(30) Foreign Application Priority Data

May 24, 2012 (FR) ..... 12 54794

(51) Int. Cl.
*D03C 3/20* (2006.01)
*D03C 13/00* (2006.01)
*D03C 3/00* (2006.01)

(52) U.S. Cl.
CPC ..... *D03C 3/205* (2013.01); *D03C 13/02* (2013.01)

(58) Field of Classification Search
CPC ..... D03C 3/20; D03C 5/00; H02K 7/10
See application file for complete search history.

(56) References Cited

U.S. PATENT DOCUMENTS

| | | | | | |
|---|---|---|---|---|---|
| 2,539,836 | A * | 1/1951 | Hoffmann | 310/77 |
| 3,109,628 | A * | 11/1963 | Eells et al. | 254/369 |
| 3,163,400 | A * | 12/1964 | Skerry | 254/369 |
| 4,039,874 | A * | 8/1977 | Sutter | 310/77 |
| 4,433,704 | A * | 2/1984 | Decuq | 139/66 R |
| 4,858,655 | A * | 8/1989 | Palau et al. | 139/76 |
| 5,069,256 | A * | 12/1991 | Goodman, Jr. | 139/83 |
| 5,070,266 | A * | 12/1991 | Janczak et al. | 310/77 |
| 5,335,564 | A * | 8/1994 | Vinciguerra | 74/567 |
| 6,050,305 | A * | 4/2000 | Braun et al. | 139/455 |
| 6,105,629 | A * | 8/2000 | Bourgeaux et al. | 139/455 |
| 6,216,750 | B1 * | 4/2001 | Braun et al. | 139/455 |
| 7,040,352 | B2 * | 5/2006 | Dagois et al. | 139/59 |
| 7,223,186 | B2 * | 5/2007 | Tresvant | 473/447 |
| 7,730,910 | B2 * | 6/2010 | Communal et al. | 139/55.1 |
| 7,806,146 | B2 * | 10/2010 | Borer | 139/55.1 |
| 2004/0261882 | A1 * | 12/2004 | Dagois et al. | 139/59 |
| 2013/0312867 | A1 * | 11/2013 | Champion et al. | 139/59 |

* cited by examiner

*Primary Examiner* — Bobby Muromoto, Jr.
(74) *Attorney, Agent, or Firm* — Dowell & Dowell, PC

(57) ABSTRACT

A shed forming device for a weaving machine includes at least one rotary electric actuator for winding, around a pulley, a funicular element controlling at least one heddle and wherein an output shaft of the actuator rotates around a first axis and wherein the output shaft is provided with a pinion meshing with a toothed crown secured to the pulley and rotatable therewith around a second axis perpendicular to the first axis.

11 Claims, 7 Drawing Sheets

SHED FORMING DEVICE AND WEAVING MACHINE EQUIPPED WITH SUCH A DEVICE

BACKGROUND OF THE INVENTION

1. Field of the Invention

The invention relates to a shed forming device designed to be installed on a weaving machine.

2. Brief Description of the Related Art

In the textile field, it is known that, on a Jacquard-type weaving machine, the formation of the weaving shed for the warp yarns of the weaving machine takes place by passing each warp yarn through the eyelet of a heddle whereof one end is connected to a spring and the other end is connected to a funicular element. The funicular element or harness is a yarn, a single- or multi-strand cable that can be wound around the pulley and follow a path defined by guide members. The principle of winding the harness around the pulley is known, for example from WO-A-4 433 704 or from EP-A-0 933 456. In the equipment of U.S. Pat. No. 4,433,704, a mechanical shaft drives some pulleys for winding the funicular elements, without use of a rotary electric actuator. In the equipment of EP-A-0 933 456, the pulley is driven by an electric actuator that controls the travel of the harness secured to the pulley. It is also known from EP-A-0 926 280 to use housings comprising up to sixteen subassemblies formed by a pulley and an associated actuator. The housings grouping together these subassemblies have the advantage of saving space on the weaving machine. Up to forty of these housings are assembled on either side of an aluminum profile that ensures their mechanical support and cooling. Each actuator commands a pulley that is removably assembled. The set of the pulleys, harnesses, heddles, springs and associated guide elements requires a significant number of assembly operations. EP-A-1 493 857 discloses a method and a device making it possible to place and disassemble sixteen pulleys from a housing simultaneously. These devices significantly improve the quality of maintenance operations, in terms of practicality and length.

The size of a weaving machine is the result of a compromise between cost and bulk imperatives, taking into account the diversity of the applications that may be involved. In parallel, the development of new weaving techniques, such as 3D weaving, requires both an increase in travel and admissible loads on the driving means of the harnesses of the weaving machine of the Jacquard type.

SUMMARY OF THE INVENTION

The invention more particularly aims to meet these objectives by proposing a new weaving shed device for a weaving machine that is easy and cost-effective to manufacture and allows a significant increase in the travel and admissible loads on the driving means of a harness.

To that end, the invention relates to a shed forming device for a weaving machine comprising at least one rotary electric actuator provided for winding around a pulley of the funicular element controlling at least one heddle, an output shaft of the actuator rotating around a first axis. According to the invention, the shaft of the actuator is provided with a pinion, meshing with a toothed crown secured to the pulley and rotatable therewith around a second axis perpendicular to the first axis.

Owing to the invention, the maximum available load at the funicular element may be increased by acting on the gear ratio formed by the pinion and the crown. Furthermore, since the pulley rotates around an axis perpendicular to the axis of rotation of the shaft of the motor, it may be supported at both ends thereof without being cantilevered. Its axial length may thus be relatively significant, which allows winding of the funicular element over a number of revolutions allowing a relatively significant travel of the heddle.

According to advantageous, but optional aspects of the invention, such a device may incorporate one or more of the following features, considered in any technically admissible combination:

- The crown is movable along the second axis and the device comprises means elastically forcing the crown toward the pinion, along the second axis.
- The shaft of the actuator and the axis of the pulley are concurrent.
- The pinion has a straight toothing and the crown has a toothing adapted to that of the pinion.
- The actuator is mounted in a housing, while the pulley and the crown are rotatably mounted around the second axis in a holder that is separate and separable from the housing.
- The device comprises several actuators mounted in a same housing, with their first respective axes parallel to each other, and several subassemblies each comprising a pulley and a crown, in a number equal to the number of actuators mounted in the housing, said subassemblies being mounted in the same holder separate and separable from the housing, with their second respective axes of rotation perpendicular to the first axes of the actuators.
- The crown and the pulley are rotatably mounted around a shaft aligned along the second axis and clipped on the holder.
- The means for elastically forcing the crown toward the pinion act between the shaft and the holder.
- The number of teeth of the pinion is smaller than the number of teeth of the crown.
- The crown is clipped and immobilized in rotation, by cooperation of shapes on the pulley.

The invention also relates to a weaving machine comprising a weaving shed device as described above.

BRIEF DESCRIPTION OF THE DRAWINGS

The invention will be better understood and other advantages thereof will appear more clearly in light of the following description of one embodiment of a weaving shed device and weaving machine according to its principle, provided solely as an example and done in reference to the appended diagrammatic drawings, in which.

DESCRIPTION OF THE PREFERRED EMBODIMENTS

Figure 1:
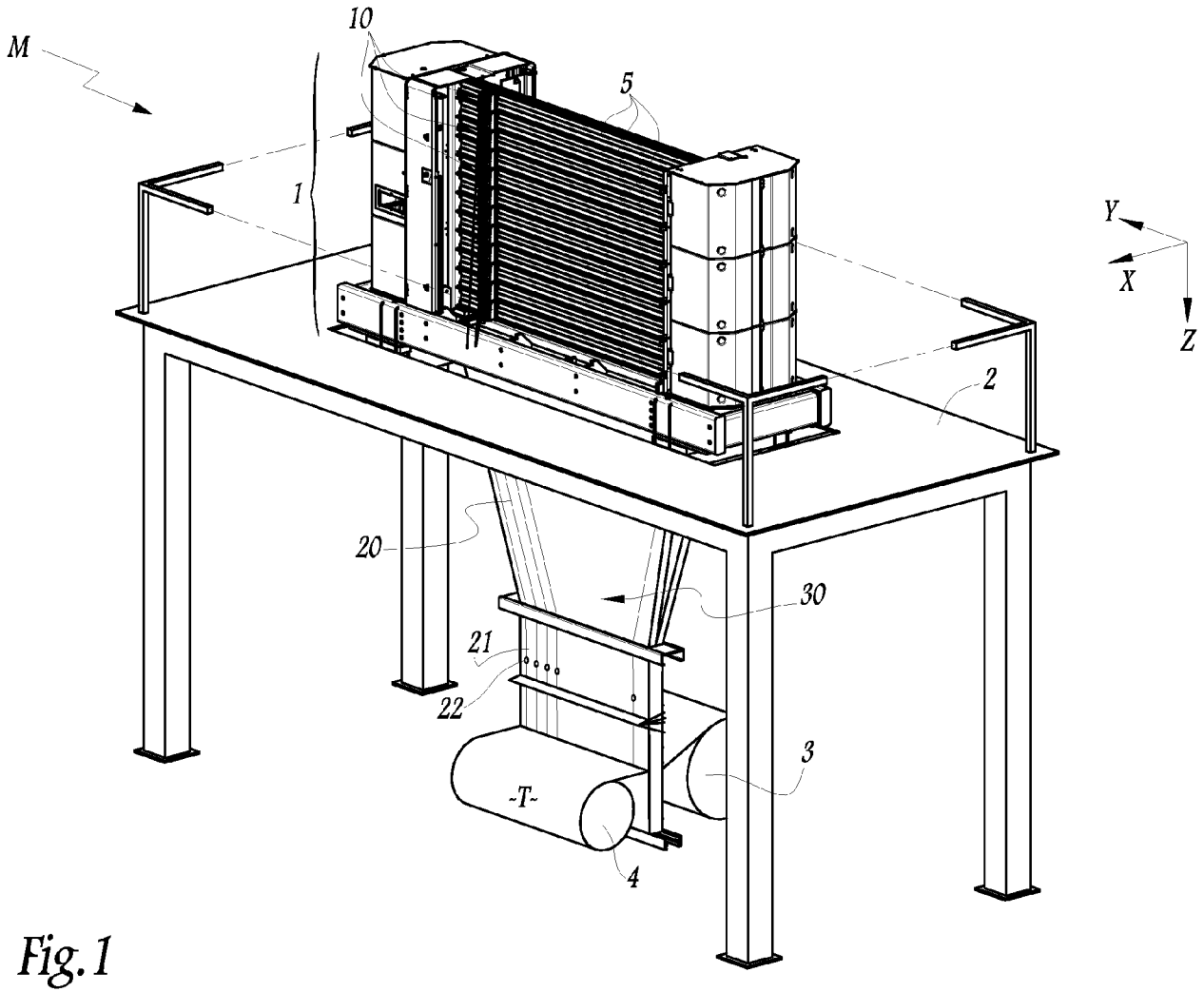
FIG. 1 is a perspective view of a weaving machine of the Jacquard type according to the invention.

The Jacquard-type weaving machine M shown in FIG. 1 comprises a weaving shed forming device 1 mounted on a superstructure 2, above the beam roll 3 and the cloth beam 4 of the machine on which a fabric T being woven is wound. The device 1 comprises several modules 10 designed to control the vertical movement of harness cords 20 making up the funicular elements of a heald frame 30 of the weaving machine M, each harness cord supporting a heddle 21 equipped with an eyelet 22 for the passage of a warp yarn. Only one column of housings 10, five harness cords 20 and five heddles 21 are shown in FIG. 1, for clarity of the drawing. Each module 10 is positioned on a rail 5. The shed device 1 comprises twelve rails, each of said rails being able to receive up to forty of said modules on either side. On each of the rails shown in FIG. 1, only the first module of each rail is shown.

Each of the modules 10 comprises a housing 110 provided to receive sixteen actuators 112 in individual housings 110A. The output shaft 114 of each of the actuators 112 is secured in rotation to a pinion 116 with a straight toothing. X114 denotes the axis of rotation of the shaft 114 and the pinion 116 of the actuator 112. The axes X114 of the actuators 112 mounted in the housing 110 are parallel to each other.

Figure 3:
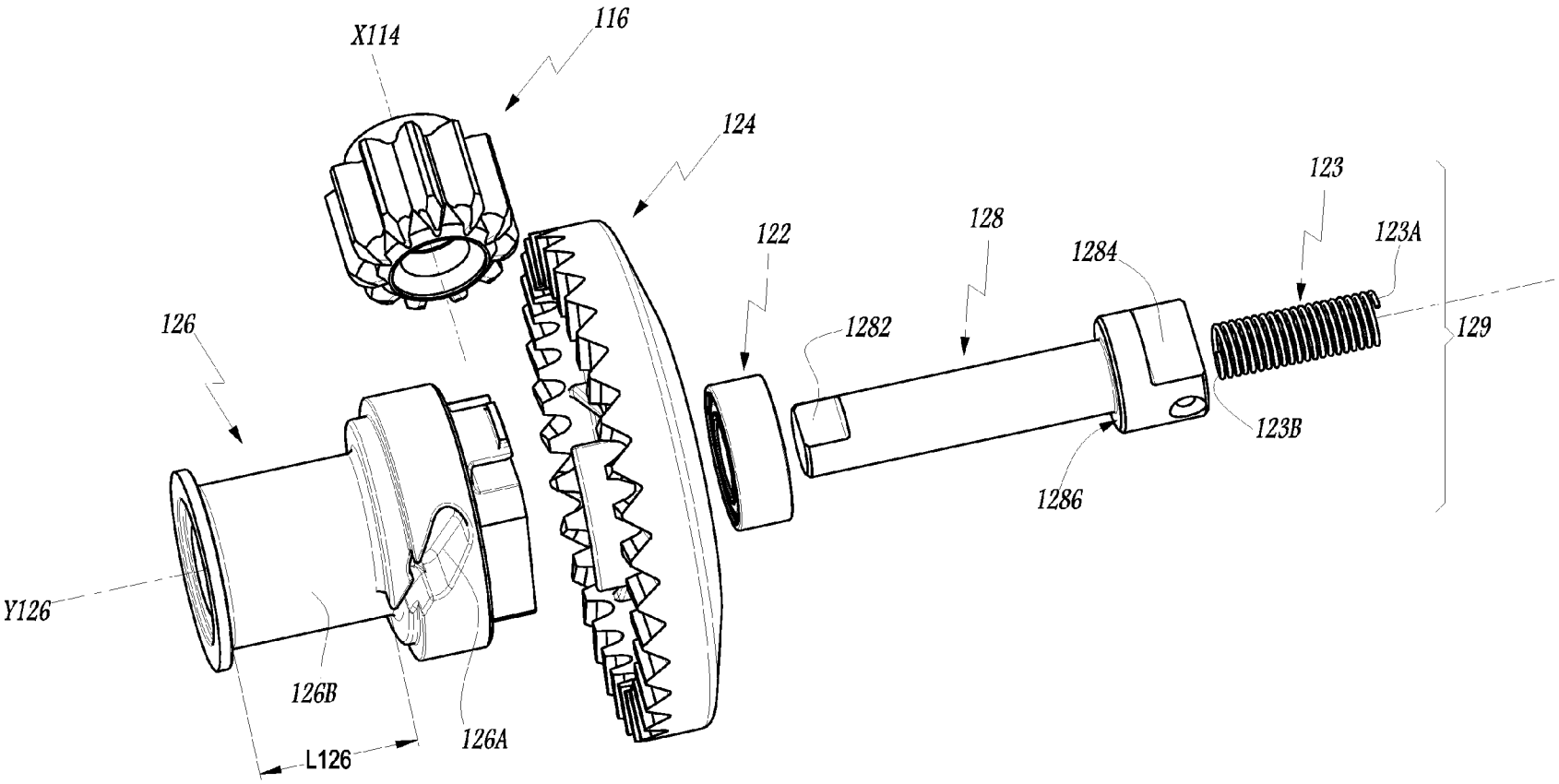
FIG. 3 is an exploded perspective view of certain elements of the module of FIG. 2.
Figure 8:
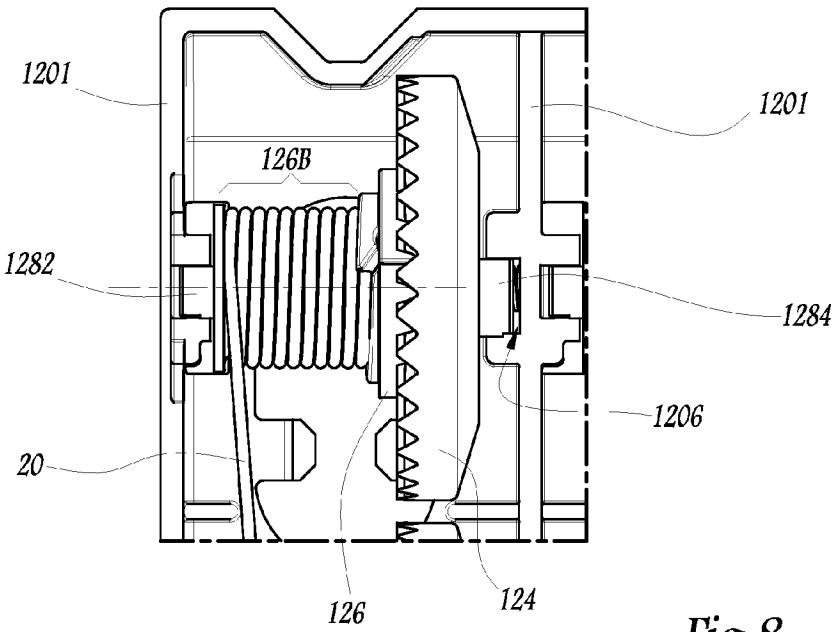
FIG. 8 is a front view of the part of the device shown in FIG. 6, showing a harness card wound on the pulley.
Figure 4:
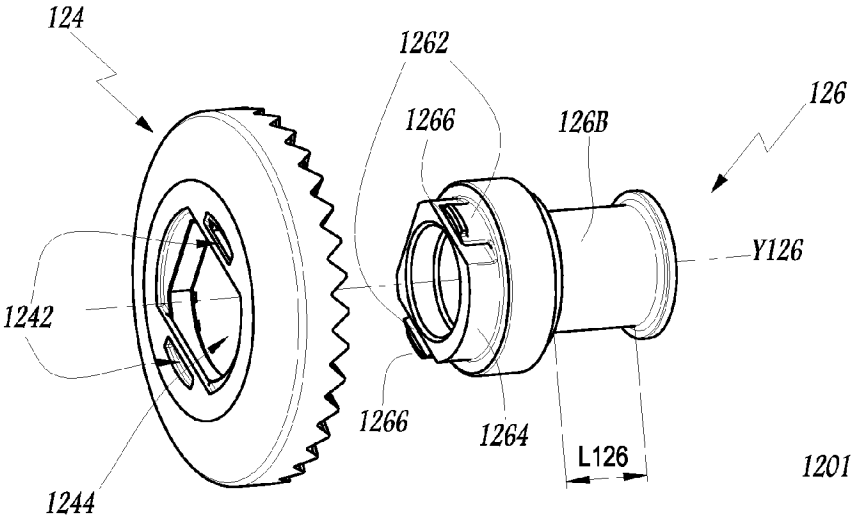
FIG. 4 is an exploded perspective view, from another angle, of the pulley and the crown shown in FIG. 3.
Figure 5:
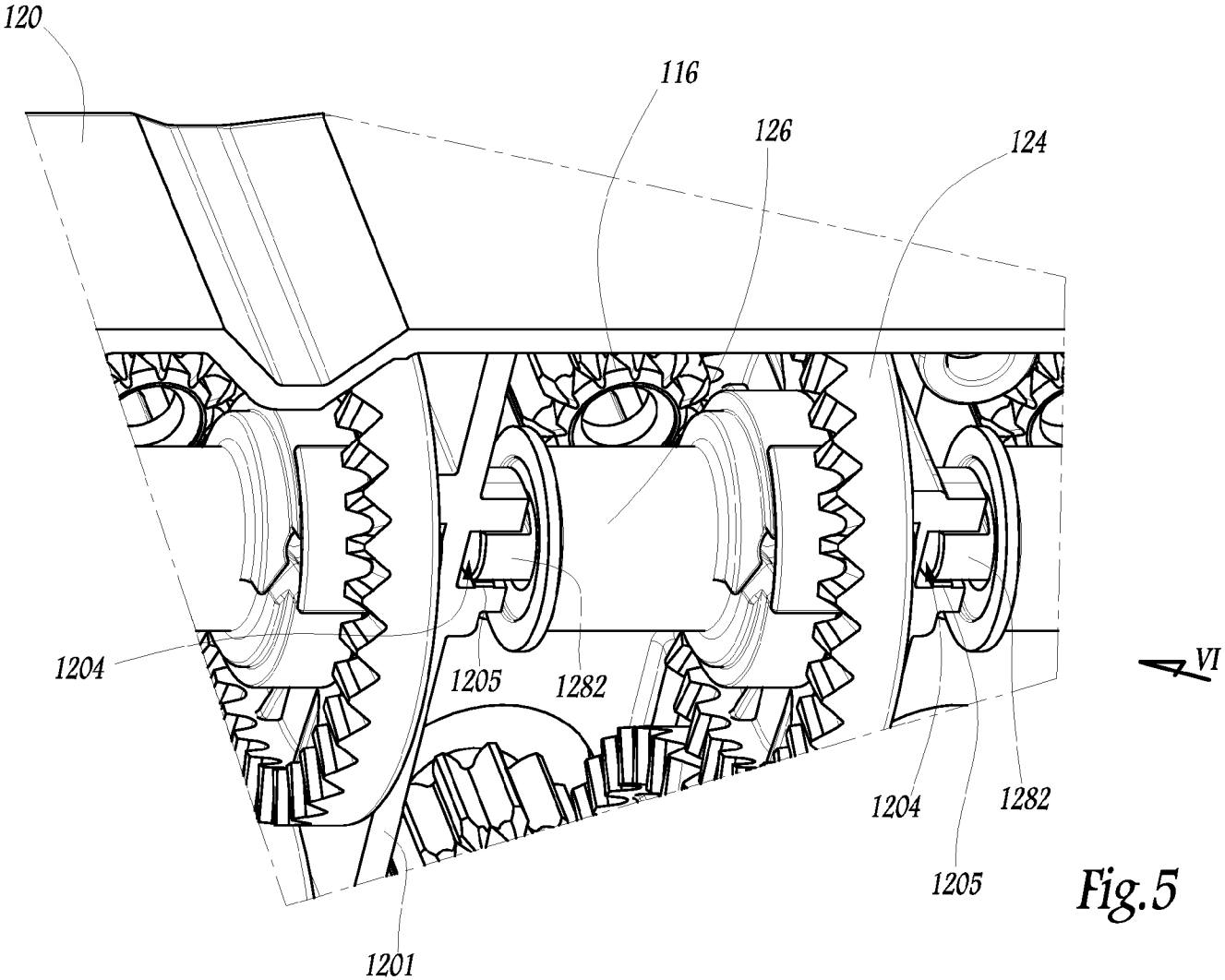
FIG. 5 is a perspective view of detail V in FIG. 2, enlarged from another angle.
Figure 6:
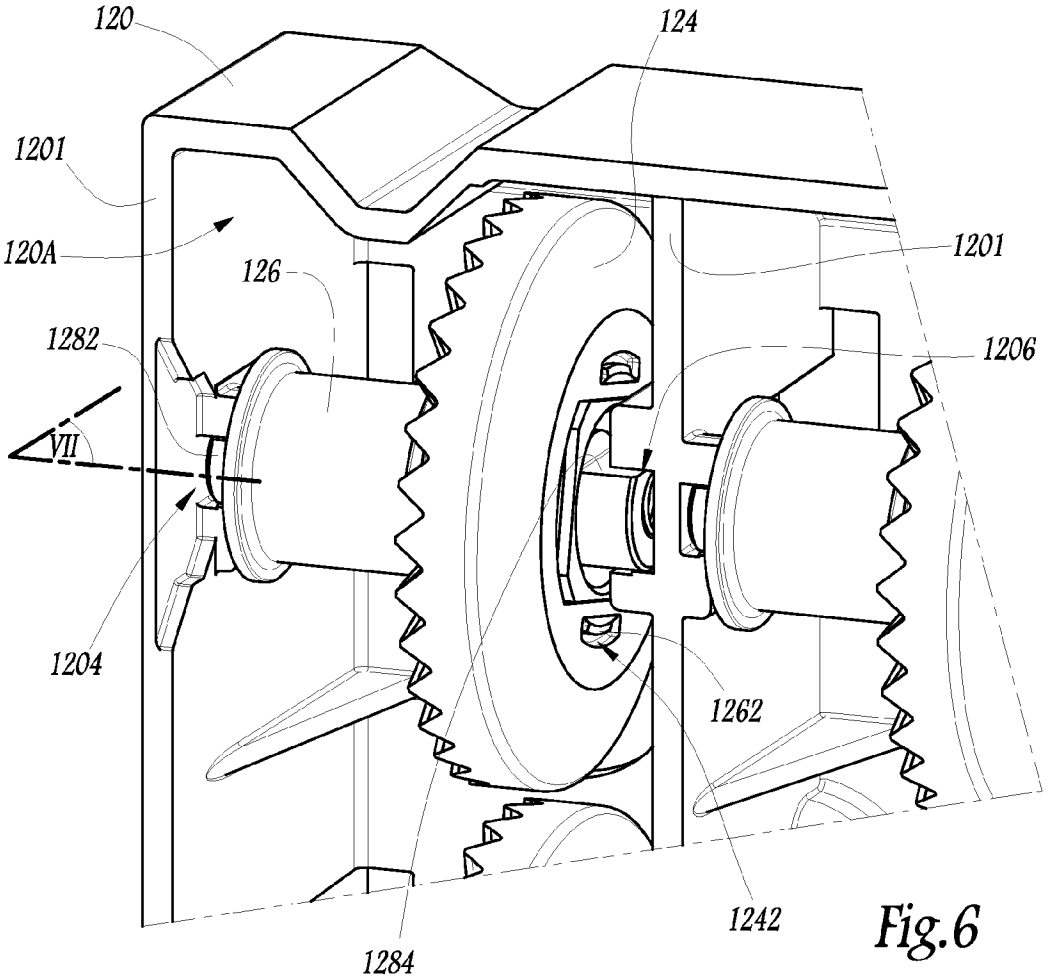
FIG. 6 is a perspective view along arrow VI in FIG. 5.
Figure 7:
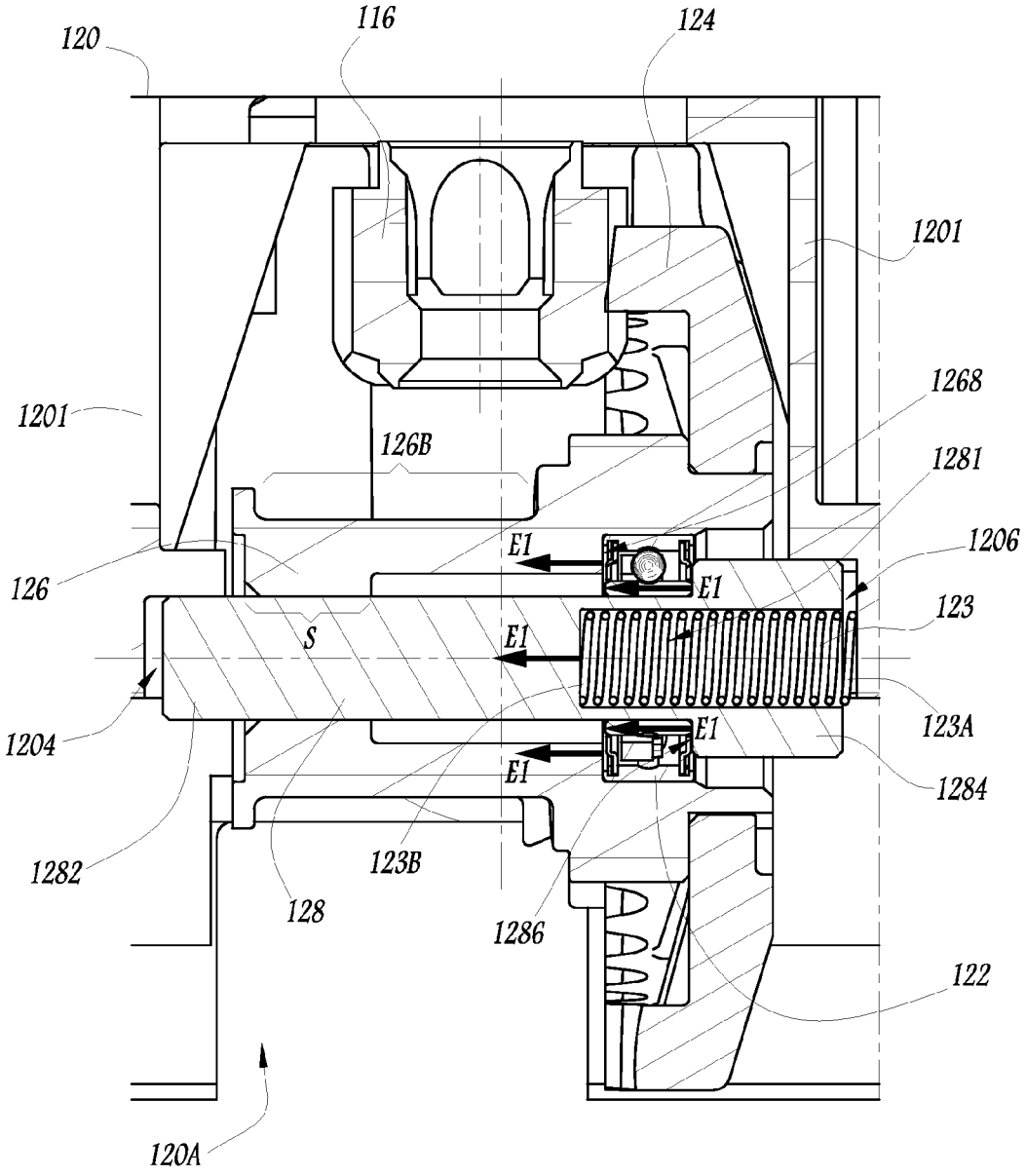
FIG. 7 is a longitudinal cross-sectional view along the shaft of a pulley subassembly, in a plane similar to plane VII in FIG. 6, but in a central part of the holder shown in FIG. 2.

Each actuator 112 is provided to drive a pulley 126 to which the upper end of a harness cord 20 is fastened. To that end, and as shown in FIG. 3, each pulley 126 is provided with a housing 126A for receiving and jamming an upper end (not shown) of the harness cord 20. Alternatively, the upper end of the harness cord 20 may be overmolded in the pulley. Each pulley 126 also comprises a cylindrical portion 126B with a circular cross-section on which a harness cord 20 can be wound whereof the end is jammed at the housing 126A. Y126 denotes the central axis of the portion 126B, which is in fact the axis of rotation of the pulley 126. L126 denotes the axial length, measured parallel to the axis Y126, of the portion 126B, i.e., the portion of the pulley 126 available for winding a harness cord.

Each pulley 126 is secured in rotation, around the axis Y126, with a toothed crown 124. Each pair consisting of a crown 124 and a pulley 126 is mounted in a housing 120A defined by a holder 120 that is attached on the housing 110.

Figure 2:
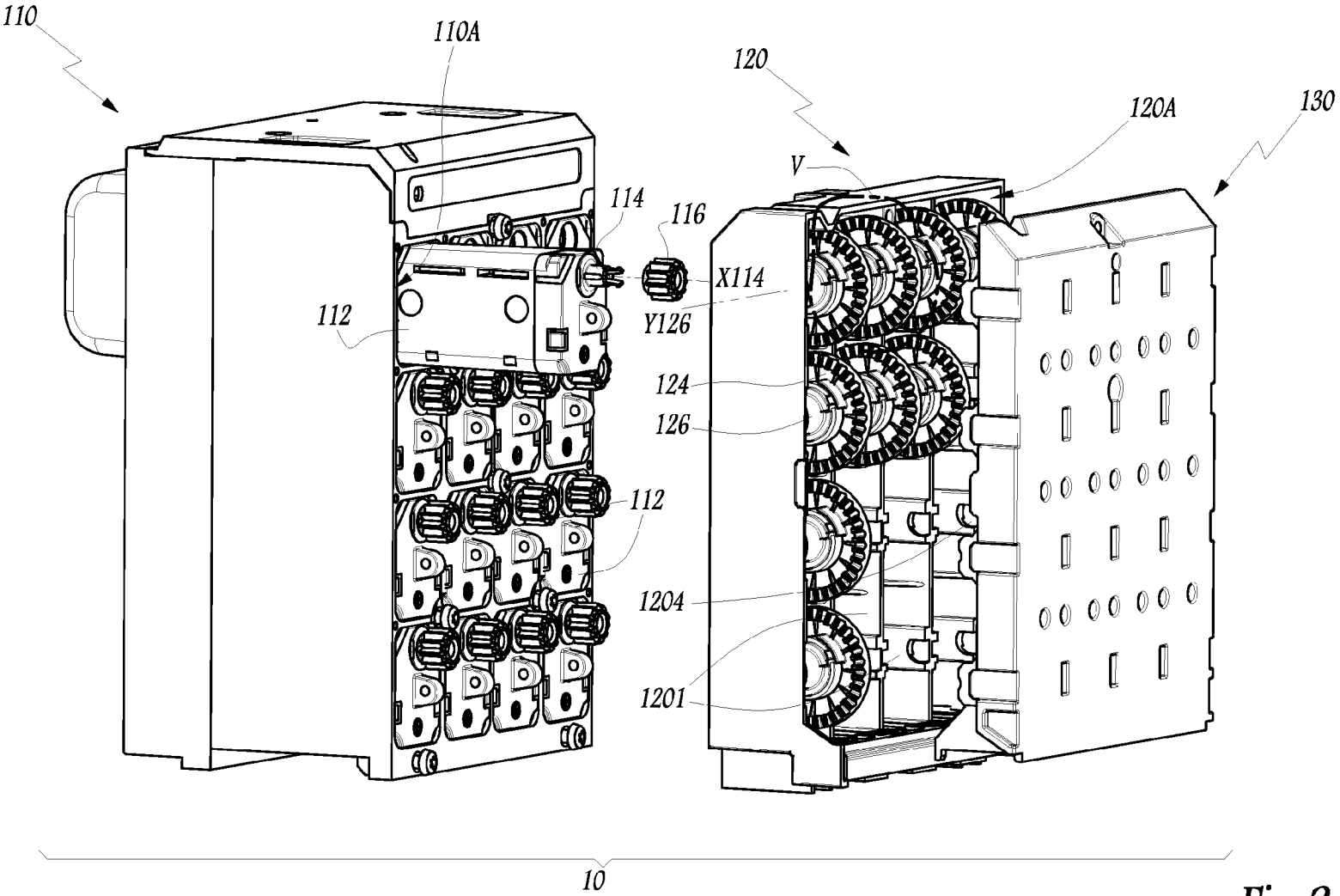
FIG. 2 is an exploded perspective view of a module belonging to the weaving shed device of the weaving machine of FIG. 1, which itself is according to the invention.

The holder 120 is open on the first side thereof turned toward the housing 110, to allow the insertion of the pinion 116 in each housing 120A. The holder 120 is also open on the second side thereof opposite the housing 110 and visible in FIG. 2. On the second side, the holder 120 is obstructed by a cover 130.

The parts 120 and 130 are advantageously made from a plastic material, for example an ABS polycarbonate alloy, that is particularly suitable due to its dimensional stability.

The holder 120 is reversibly mounted on the housing 110, for example using screws (not shown). Likewise, the cover 130 is reversibly mounted on the holder 120, for example clipped thereon.

In the mounted configuration of the module 10, each pinion 116 of the actuator 112 is engaged with a crown 124, which in turn is secured to a pulley 126, while the axes of rotation X114 and X126 of said parts are perpendicular.

The placement of a pinion 116 and a crown 124 as intermediate parts between the actuator 112, which generates the rotating movement of the pulley 126, and the pulley 126, on which the harness cord 20 is wound, allows the creation of a reduction gear. The number of teeth of the pinion 116 is smaller than the number of teeth of the crown 124. This makes it possible to obtain a gear reduction effect of the torque obtained at the shaft 114 and which is transmitted to the pulley 126 by the reduction gear formed by the parts 116 and 124. By acting on the ratio of the torque from the gear made up of the pinion 116 and the crown 124, the maximum available load at the harness cord 20 may thus be adapted to the tractive forces to be generated on each harness cord 20.

The ratio of the number of teeth of the crown 124 to the number of teeth of the pinion 116 is ⅓ in the chosen embodiment and may be comprised between ½ and ⅕.

The pinion 116 has a straight toothing and cooperates with the crown 124, the toothing of which is adapted to that of the pinion. In practice, the toothing of the crown is of the "Cylkro" type, as known from WO-A-96/12585. In the example of the device considered an shown in FIGS. 1 to 8, the pinion has eleven teeth with module 0.7, while the crown has thirty-three teeth. The use of the straight toothing enables relatively imprecise positioning of the crown 124 along the axis X114. In fact, the contact conditions remain the same along a tooth of the pinion. Furthermore, the meshing does not generate any resultant on the pinion oriented along the axis X114. The meshing therefore has no consequence on the operating conditions of the bearings of the shaft of the actuator.

The pinion and the crown are made from polyacetal, the choice of this plastic material allowing operation without adding lubricant and guaranteeing good resistance to wear.

The crown 124 and the pulley 126 are mounted freely rotating, with the interposition of a ball bearing 122, around a shaft 128 whereof the longitudinal axis is aligned with the axis Y126. Since the axes X114 and Y126 are perpendicular, the shaft 128 extends between two walls 1201 of the holder 120 that are vertical in FIG. 2, while the axes X114 and Y126 are horizontal.

A housing 1244 of the crown 124 is provided to receive a nose 1264 of the pulley 126. The housing 1244 and the nose 1264 have complementary and noncircular shapes. Thus, the assembly of the pulley 126 on the crown 124 ensures rotational securing with axis Y126 of the crown and the pulley, by cooperation of shapes.

Furthermore, the pulley 126 is mounted on the crown 124 by clipping the nose 1264 of the pulley 126 in the housing 1244, using elastically deformable tongues 1262 provided with end beaks 1266. The beaks 1266 of the tongues 1262 are clipped in slits 1242 of the crown 124 provided to that end, on either side of the housing 1244. This clipping of the pulley 126 on the crown 124 thereby ensures that they are translatably secured along the axis Y126.

A spring 123 is positioned between the shaft 128 and a wall 1201 of the holder 120. It exerts an elastic force E1 on said shaft oriented toward the other wall 1201 of the housing 120A in which said shaft is received.

A pulley subassembly 129 is considered comprising a pulley 126, a crown 124, a ball bearing 122, a spring 123 and a shaft 128. Each subassembly 129, whereof the shaft 128 is the central member, is positioned in a housing 120A of the holder 120.

In the normal usage configuration, one end 123A of the spring bears against the wall 1201 of the holder 120, while the other end 123B is in contact with the bottom of an inner bore 1281 of the shaft 128. The spring 123 thus exerts the elastic force E1 on the shaft 128. The ball bearing 122 resting on a shoulder 1286 of the shaft 128, the shaft also exerts a force E1 on the ball bearing 122, which in turn exerts that force E1 on the pulley 126, at an inner shoulder 1268 of the pulley.

The use of an elastic forcing means such as the spring 123 makes it possible to react the meshing play between the pinion 116 and the crown 124, along the axis Y126, the crown being elastically recalled toward the pinion.

It is possible to clip the ends 1282 and 1284 of the shaft 128 in housings 1204 and 1206 formed in the walls 1201 and provided to that end. The ends 1282 and 1284 have a noncircular cross-section and the housings 1204 and 1206 have geometries compatible with the placement of the ends 1282 and 1284 and with blocking thereof in rotation around the axis Y126. Furthermore, each housing 1204 is bordered by an elastically deformable tooth 1205 that serves as a retaining member for the end 1282 of the shaft 128 placed in the housing 1204. This tooth retracts during the placement of the shaft 128 in the housing 1204, after which the shaft 128 is clipped and kept in place by the tooth 1205. A similar tooth is provided at the housing 1206, such that the end 1284 of the shaft 128 is kept in place. Alternatively, another clipping member, or more generally retaining member, may be provided at the housings 1204 and 1206.

The shaft 128 thus clipped is immobilized in rotation on the axis Y126 and has a certain axial freedom. The pulley 126, whereof the shaft is maintained at both ends by the holder 120, is stable on its axis since it is not cantilevered. Furthermore, it rotates around the shaft 128 by means of two bearings made up on the one hand of the ball bearing 122 and on the other hand of a smooth contact area S between the inner bore of the pulley 124 and the outer cylindrical surface of the shaft 128 situated opposite the ball bearing 122. The two bearings are located on either side of the winding portion 126B of the harness cord 20. It thus becomes possible to increase the length L126 of the portion 126B receiving the harness cord 20, without decreasing the stability of the pulley. In practice, the length L126 is comprised between 8 and 10 mm for a pulley 126 where of the portion 126B has a diameter of approximately 9 mm. Under these conditions, the winding length of the harness cord 20 in the configuration of FIG. 8 has a value comprised between 270 and 290 mm.

The length L126 is increased with respect to the axial length of the pulleys of the prior devices. This increased length makes it possible to wind a more significant harness length around the pulley. This thereby makes it possible to increase the possible travel for the heddles 21, with respect to the known devices. In particular, the multilayer 3D weaving applications that involve forming several superimposed sheds or moving the shed along the woven layer are easily achievable.

The device reacting play along the axis Y126, owing to the spring 123, previously described operates identically for the sixteen pulley subassemblies 129 contained by the holder 120. In particular, it enables individual self-adjustment of the axial position along the axes Y126 of the sixteen crowns 124 of the pulley subassemblies 129 mounted on the holder 120, with respect to the sixteen pinions 116 of the actuators 112 mounted on the housing 110, when the holder 120 is attached on the housing 110.

According to one very advantageous aspect of the invention, the axes X114 and Y126 are concurrent. Thus, the distribution of the assembly tolerances of the pinions 116 and the pulley subassemblies 129 is centered on a nominal configuration where said axes are in fact secant. Thus, in the event of variation of the position of said axes, the toothings of the elements 116 and 124 remain engaged, under satisfactory meshing conditions. In other words, due to the concurrent nature of the axes X114 and Y126, the reduction gear formed by the elements 116 and 124 is not particularly sensitive to positioning flaws along the axis Z perpendicular to the axes X114 and Y126 that are distributed on either side of the nominal configuration where said axes are in fact concurrent.

Alternatively, these axes may not be concurrent, which is possible in light of the types of toothing used.

In this way, the positioning of the crown 124 and the axis of the actuator X114 does not need to be precise. The device is therefore compatible with an assembly without minute adjustment. The design of the device makes it possible to adapt the meshing conditions in the directions of the axes X114 and Y126, as well as an allowance in direction Z.

The pulley subassemblies 129 are supported by the holder 120, which is a separate part from the housing 110. In this way, the sixteen subassemblies 129 and their holder 120 make up a removable functional unit that is easy to disassemble to perform maintenance operations both on the actuators 112 and the pulley subassemblies 129. The assembly of a weaving shed device according to the invention is done by equipping each housing 110 with actuators 112 mounted in the housing 110A. A pinion 116 is mounted on the shaft 114 of each actuator 112 before or after assembly thereof in the housing 110. Then, the holder 120 equipped with the pulley subassemblies 129 is attached on the housing 110. Next, the cover 130 is mounted on the holder 120.

During the placement of the holder 120 on the housing 110, the crowns 124 come into contact with the end bevel of the teeth of the pinions 116, then shift along the axis of the pulley 126 shaft Y126 against the action of the spring 123. The spring returns the toothings to the meshing configuration, without action by the operator. Once in place, the pinions 116 and crowns 124 are in operating condition, without play and without a specific adjustment operation being necessary.

The installation of such a device also makes it possible to recondition a weaving machine from the state of the art into a weaving machine according to the invention. In practice, the transition from a simple cantilever pulley system to a gear system may include the following three steps. First, and for each actuator, the pulley is replaced by a pinion 116. Then, the holder 120 is mounted on the housing 110 and the cover on the holder, as explained above.

Alternatively, the invention may be implemented with conical gears. These gears with concurrent axes require, to operate under optimal conditions, that the apices of the toothing cones coincide. The device for reacting the play along the axis of rotation of the pulley enables a satisfactory adjustment of the play.

The invention may also be implemented with hypoid gears, i.e., with left spiral gears. The pinions and crowns have conical teeth, but do not necessarily rotate around concurrent axes.

The invention claimed is:

1. A shed forming device for a weaving machine comprising at least one rotary electric actuator provided for winding around a pulley of a funicular element controlling at least one heddle, an output shaft of the actuator rotating around a first axis, wherein the output shaft of the actuator is provided with a pinion, meshing with a toothed crown secured to the pulley and rotatable therewith around a second axis which is perpendicular to the first axis.

2. The device according claim 1, wherein the crown is movable along the second axis and in that the device means for elastically forcing the crown toward the pinion along the second axis.

3. The device according to claim 1, wherein the output shaft of the actuator and the axis of the pulley are concurrent.

4. The device according to claim 1, wherein the pinion has a straight toothing and the crown has a toothing adapted to the toothing of the pinion.

5. The device according to claim 1, wherein the at least one rotary electric actuator is mounted in a housing, and in that the pulley and the crown are rotatably mounted around the second axis in a holder that is removably mounted within the housing.

6. The device according to claim 5, including a plurality of actuators mounted in the housing, with their first respective axes parallel to each other, and a plurality of subassemblies each including a pulley and a crown, in a number equal to the number of actuators mounted in the housing, and in that the subassemblies are mounted in the holder that is removably mounted within the housing, with their second respective axes of rotation perpendicular to the first axes of the actuators.

7. The device according to claim 5, wherein the crown and the pulley are rotatably mounted around a shaft aligned along the second axis and clipped on the holder.

8. The device according to claim 7, wherein the means for elastically forcing the crown toward the pinion along the second axis acts between the shaft and the holder.

9. The device according to claim 1, wherein the number of teeth of the pinion is less than the number of teeth of the crown.

10. The device according to claim 1, wherein the crown is clipped and retained in rotation by cooperation of shapes on the pulley.

11. A weaving machine comprising a weaving shed device according to claim 1.

* * * * *